United States Patent [19]

Towne et al.

[11] 3,946,598

[45] Mar. 30, 1976

[54] METHOD AND APPARATUS FOR DETERMINING THE DYNAMIC PARAMETERS OF SOIL IN SITU

[75] Inventors: Robin M. Towne, Portland, Oreg.; Stanley G. Champ, Tacoma, Wash.

[73] Assignee: Robin M. Towne and Associates, Inc., Seattle, Wash.

[22] Filed: July 11, 1974

[21] Appl. No.: 487,460

[52] U.S. Cl. ..... 73/67.1; 73/12

[51] Int. Cl.[2] ..... G01N 3/30

[58] Field of Search..... 73/84, 88 E, 12, 82, 67.1, 73/560, 561

[56] References Cited

UNITED STATES PATENTS

| | | | |
|---|---|---|---|
| 3,222,919 | 12/1965 | Shoor et al. | 73/67.1 |
| 3,498,388 | 3/1970 | Jovis | 73/84 |
| 3,535,919 | 10/1970 | Budlong et al. | 73/84 |

*Primary Examiner*—James J. Gill
*Assistant Examiner*—Anthony V. Ciarlante
*Attorney, Agent, or Firm*—Christensen, O'Connor, Garrison & Havelka

[57] ABSTRACT

The dynamic parameters of soil in situ are determined by: impacting freely suspended piles and measuring the force applied to and the acceleration of the piles; analyzing the measured information to determine the transfer function (impedance) of the piles; driving the piles into the soil whose dynamic parameters are to be determined; impacting one of the piles driven into the soil; measuring the force applied to and the acceleration of the driven pile; measuring the acceleration produced by the driven pile at at least one remote pile; analyzing the measured information obtained with the piles located in the soil to determine the transfer functions of the soil plus the piles; and, subtracting the transfer functions of the piles from the transfer functions of the piles plus the soil to determine the transfer function of the soil. The transfer function when plotted depicts the dynamic parameters of the soil. The analysis is performed using Fourier techniques whereby the force and acceleration measurements are converted from the time domain to the frequency domain. In addition, acceleration measurements are converted from an acceleration form to a velocity form. The Fourier transformed force measurements are divided by the Fourier transformed velocity measurements to create transform functions prior to the subtraction step being performed. In addition, errors contained in the force measurements created by any mass located between the impacting mechanism and the impacted or force pile are eliminated prior to converting the force measurements from the time domain to the frequency domain. Further, the resultant transform information is analyzed to determine if it is valid (only created by the applied force) or invalid (created by the applied force plus some external, uncontrolled force).

32 Claims, 5 Drawing Figures

METHOD AND APPARATUS FOR DETERMINING THE DYNAMIC PARAMETERS OF SOIL IN SITU

BACKGROUND OF THE INVENTION

This invention relates to testing soil and, more particularly, to determining the dynamic parameters of soil.

In order for an architect or civil engineer to design a building or structure that is adequate to withstand dynamic ground forces, it is necessary for him to know the parameters of the soil that will ultimately support the building or structure, and in particular the dynamic parameters of such soil. This information is needed for two principle reasons. First, it is needed so that adequate building support and design will be provided. Second, it is needed so that the support pilings can be driven with a force adequate to drive them into the soil, but inadequate to damage surrounding structure or buildings. More specifically, by knowing the dynamic parameters of the soil, an architect or engineer can determine the amount of force that can be applied to a pile during a pile driving operation without such force having a detrimental effect on surrounding buildings or structure, such as breaking the windows of such buildings or structures, for example.

The most commonly used prior art technique for determining the dynamic parameters of soil requires the obtaining of soil samples (core samples). These samples are analyzed in detail in a suitable laboratory. The results are often not as accurate as desired The principle reason for the resultant inaccuracies relates to the change in the boundary conditions created when the soil is tested in this manner. That is, because the soil is removed to a laboratory, the natural boundary conditions existing at the soil site do not exist during analysis. To the extent that the boundary conditions effect the in situ dynamic parameters of the soil, the laboratory analysis is in error.

Therefore, it is an object of this invention to provide a method of determining the dynamic parameters of soil without requiring the removal or undue disturbance of the soil, i.e., without disturbing the natural boundary conditions of the soil.

It is a further object of this invention to provide a method of and an apparatus for determining the dynamic parameters of soil in situ.

It is also an object of this invention to provide an apparatus for rapidly and accurately determining the dynamic parameters of soil in situ.

SUMMARY OF THE INVENTION

In accordance with principles of this invention, a method of determining the dynamic parameters of soil in situ is provided. The method generally comprises the step of: determining the transfer function (impedance) of piles; determining the transfer function of the piles plus soil after the piles have been driven into the soil; and, subtracting the transfer functions of associated piles from the transfer function of the piles plus the soil to determine the transfer function of the soil.

As used herein the term "pile" is to be given a broad meaning. It covers wooden poles, steel rods, concrete piles or other devices that can be driven into and impale the soil. This term, as used herein, also covers a spread footing that is poured in contact with the soil in a manner such that when impulsed it will excite the surrounding soil in the manner contemplated herein.

In accordance with further principles of this invention, the transfer functions of the piles are determined by separately, freely suspending the piles and impacting them. The applied force and the acceleration caused by the applied force to each freely suspended pile are measured. The measured information is either recorded and subsequently used, or immediately used, to determine the transfer functions of the impacted piles. Recording is preferred because it allows all analysis to be performed at a common location, such as a laboratory, for example.

In accordance with other principles of this invention, the pile and soil transfer functions are determined by driving the piles to a common depth into the soil whose dynamic parameters are to be determined. Thereafter, one of the piles, the driving or force pile, is impacted, i.e., a force is applied to it. The force applied to and the acceleration of the driving pile caused by the applied force is measured. In addition, the acceleration of one or more remote piles caused by the applied force is measured. This measured information is also either recorded or used immediately to determine the pile plus soil transfer function(s).

In accordance with still other principles of this invention, the force and acceleration measurements create transfer functions by first converting the measurements, using Fourier techniques, from the time domain to the frequency domain. In addition, acceleration measurements are converted from acceleration form to velocity form (acceleration ÷ frequency). The converted force measurements are then divided by the converted velocity measurements to provide transfer functions. Then, the transfer functions related to the associated piles alone is subtracted from the transfer functions related to the soil plus piles, resulting in transfer functions solely related to the soil. By associated is meant the piles associated with each set of force and acceleration measurements taken when the piles are located in the soil. Both the driving point transfer function (formed at the force pile) and a series of transfer point transfer functions (formed at the remote piles) are determined in this manner.

In accordance with further principles of this invention, errors related to certain mass, such as support structures for force measuring transducers, are subtracted from the measured force in order to obtain a true representation of applied force prior to Fourier transformation. Moreover, the measured acceleration information is analyzed either prior, or subsequent, to the transfer functions being determined in order to determine whether or not the measured information is: (1) valid, i.e., whether or not it relates to the force applied to the driving pile only; or (2) invalid, i.e., whether or not it relates to the force applied to the driving pile, plus externally created, uncontrolled force.

In accordance with further principles of this invention, an apparatus for determining the dynamic characteristics of soil in accordance with the method of the invention is provided. The apparatus comprises: a plurality of piles; transducers for measuring force applied to the piles and the acceleration of the piles created by the applied force; a force creating mechanism; and, an analyzing mechanism for analyzing the measured information. The force creating mechanism may be an external mechanism, such as a pile driver, for example, or an internal mechanism, such as an explosive charge released in the pile, for example. Preferably, a recording mechanism, such as a multiple channel tape recorder, is used to first record signals related to the force and acceleration created when the piles are freely suspended and impacted. Thereafter, signals related to the force and acceleration, created after the piles are driven to equal depths in the soil whose dynamic parameters are to be determined and one is impacted, are recorded. In this manner a series of related force and acceleration signals are obtained and stored for later analysis at a remote location, such as a laboratory, for example.

In accordance with further principles of this invention, the analysis mechanism includes amplifiers and filters adapted to simultaneously amplify and filter a force signal and a related acceleration signal. If some objectionable mass other than the mass of the associated pile, such as a support for the force measuring transducer is associated with the force signal, the effect of that mass is deleted from the force signal. The thusly conditioned force and acceleration signals are applied to a Fourier analyzer. The Fourier analyzer converts the signals it receives from the time domain to the frequency domain, and converts the acceleration signal into a velocity signal (velocity = acceleration ÷ frequency). The transformed force signal is then divided by the transformed velocity signal to produce a transfer function (impedance) signal. The Fourier analyzer performs these steps on each related set of force and acceleration signals and temporarily stores the resultant transfer function signals. Thus, a series of transfer function signals are created, some of which are related to the transfer functions of the piles only (based on the measurements made when the piles are freely suspended) and other of which are related to the piles plus soil (taken when the piles were located in the soil). The related "pile" transfer function signals are subtracted by the Fourier analyzer from the "pile plus soil" transfer function signals in order to produce transfer function signals solely related to the soil. The soil transfer function signals are applied to a suitable plotting mechanism to create displays from which soil dynamic stiffness, soil dynamic mass, soil damping and soil resonances are readily determined.

In accordance with other principles of this invention, the apparatus includes a phase meter which measures the phase difference between the various force and acceleration signals as they are applied to the Fourier analyzer. The resultant phase difference signals are plotted by a suitable plotting mechanism against frequency, the frequency component being derived from the Fourier analyzer.

In accordance with further principles of this invention, the Fourier analyzer also determines whether or not the acceleration signals are valid or invalid. More specifically, the Fourier analyzer determines whether or not the measured acceleration signals are due only to the applied force or also to other extraneous, uncontrolled, forces. In this regard, the Fourier analyzer converts the measured acceleration signals from the time domain to the frequency domain and determines the power spectrum of these signals both at the driving or force pile and at each remote pile. The cross-power spectrum between the converted driving point acceleration power spectrum signal and each converted transfer point acceleration power spectrum signal is then computed and squared by the Fourier analyzer. Finally, the coherence function between each of the resultant signals is determined. Lack of coherence results in the rejection of the related acceleration signals.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings wherein.

DESCRIPTION OF THE PREFERRED EMBODIMENT

This invention is directed to a method of and an apparatus for determining the dynamic parameters of soil without displacing the soil other than by the insertion of a pile, i.e., the determination is made in situ. Because the determination is made without displacing the soil, the effect on the dynamic parameters of the soil created by the existing natural boundary condition is not lost.

In general, the invention achieves its desired result by determining a series of transfer functions (impedances). The series includes transfer functions of two different types, one type is related to the transfer functions of the piles themselves and the other is related to the transfer functions of the piles plus the soil. By subtracting the transfer functions of the piles themselves from the transfer functions of the piles plus the soil, the transfer function of the soil can be determined. The transfer functions are determined by measuring an impacting force applied to the piles and the acceleration of the piles which result from the applied force. The measured information is transferred from the time domain to the frequency domain and the acceleration information is converted to velocity information. Then, the transformed force information is divided by the transformed velocity information to obtain the resultant transfer function (impedance) information. As will be better understood from the following description, various errors which could exist in the resultant information are eliminated by the invention.

Figure 1:
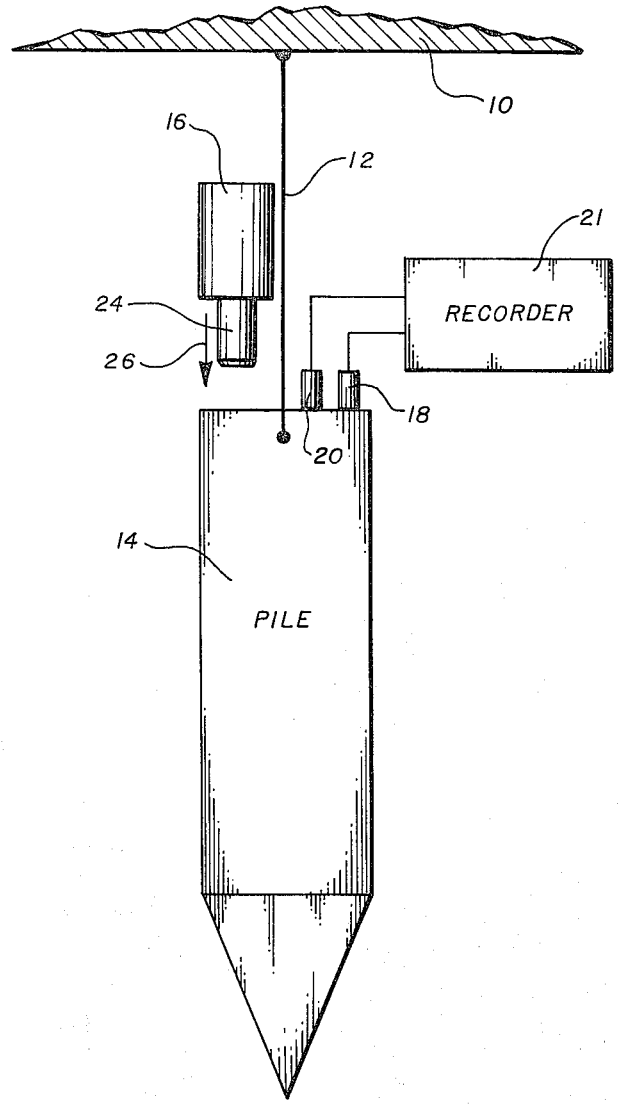
FIG. 1 is a block diagram illustrating a mechanism suitable for freely suspending a pile such that measurement signals (force and acceleration) related to the transfer function of the pile can be obtained.

FIG. 1 illustrates an apparatus formed in accordance with the invention for obtaining signals related to the transfer functions of the individual piles to be later driven into the soil whose dynamic parameters are to be determined. Each pile 14 is suspended by a suitable suspension system (one having a natural frequency well below that of the piles) illustrated schematically as a cable 12 attached to a fixed support 10. After suspension, a suitable impacting force is applied to the suspended pile 14. In the schematic illustration, a force hammer 16 which includes a driven element 24 movable in the direction of the arrow 26 creates the impacting force. For purposes of illustration clarity, the force hammer is offset from the pile centerline; however, it will be appreciated that in actual use, the force would be applied along the pile centerline. In this regard, an alternative to a force hammer or other mechanical system is an explosive system wherein an explosive charge is detonated in the pile to create the desired force.

When impacted, the suspended pile is accelerated. A suitable force measuring device 18, such as a strain gauge transducer, measures the applied force and creates a related force signal. The force is recorded on one track of a multiple track tape recorder 21. At the same time, a suitable acceleration measuring device, such as an accelerometer 20, measures the acceleration of the pile 14 and creates a related acceleration signal. The acceleration signal is simultaneously recorded on another track of the multiple track tape recorder 21. As indicated above, the same steps are performed for each pile to be subsequently driven into the soil. The signals recorded on the multiple track tape recorder 21, as will be better understood from the following description, are subsequently utilized to create the transfer function signals relating to the various piles. The resultant transfer function signals are subtracted from transfer function signals related to the transfer functions (impedances) of the piles plus the soil.

Figure 2:
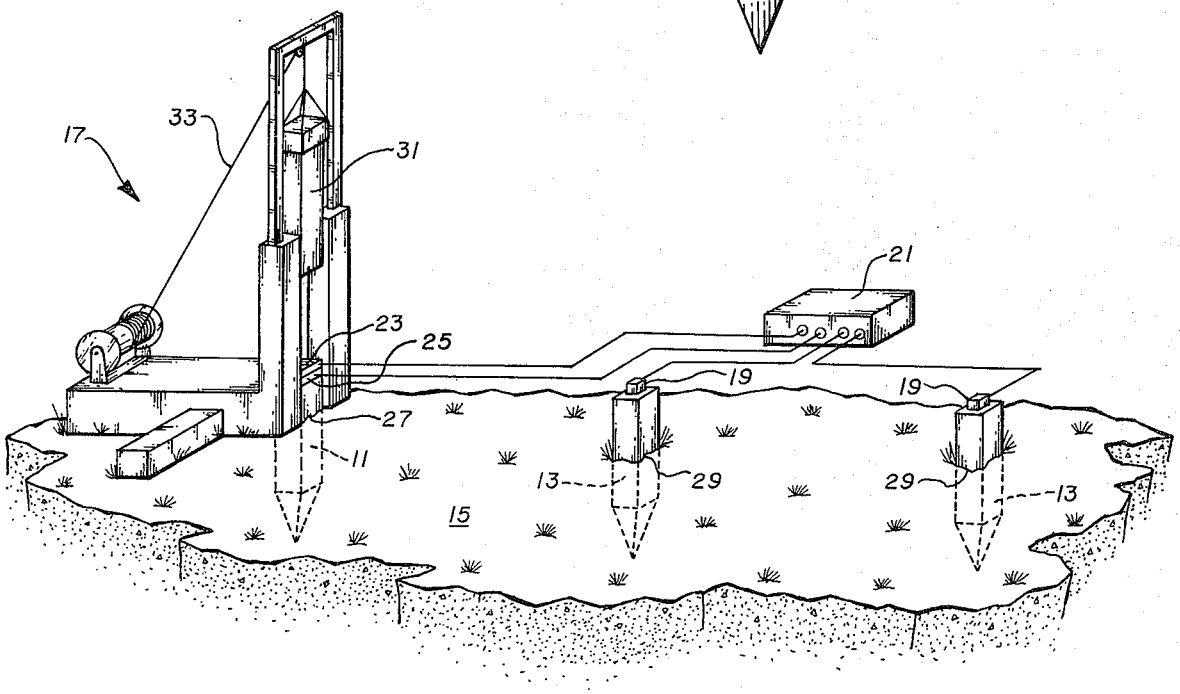
FIG. 2 is a pictorial diagram illustrating a mechanism formed in accordance with the invention for obtaining signals (force and acceleration) related to the transfer function or soil plus piles.

Turning now to FIG. 2, as illustrated therein, a plurality of piles including a force pile 11 and a plurality of remote piles 13 are driven to equal depths in the soil 15. Any suitable well known driving mechanism such as a pile driver 17 can be utilized to drive the piles to the desired depth. Thereafter, accelerometers 19 are mounted on each of the remote piles 13 and connected to a suitable recording mechanism such as the multiple track tape recorder 21. In addition, a force measuring device, such as a strain gauge transducer 23, is mounted atop the force pile 11 and connected to the tape recorder 21. The force measuring device may be separated from the force pile 11 by a suitable support mass (not shown). Further, an accelerometer 25 is mounted on the force pile 11 and connected to the tape recorder 21. The connections to the tape recorder are such that the force and acceleration signals generated by the force measuring device and the accelerometers are all simultaneously recorded. For purposes of discussion, the junction point 27 between the ground level and the force pile 11 is referred to as the driving point and the junctions 29 between ground level and the remote piles 13 are referred to as transfer points.

While the piles are illustrated as wood or iron piles that can be driven into the soil, it is to be understood that the piles could be poured concrete piles or footings. Obviously, a similar pile must be formed outside of the soil for use in obtaining force and acceleration signals related to the transfer functions of the poured piles, as herein described. In any event, the important feature to note is that the piles are embedded in the soil.

The pile driver 17 is located such that its hammer 31 is located above the strain gauge transducer 23. The pile driver 17 may take on any conventional form. As illustrated, the hammer 31 is raised by a cable 33 wrapped about a drum 35. When the hammer 31 reaches a suitable height above the force measuring transducer 33, the cable is released and the hammer 31 drops vertically and impacts on the top of the strain gauge transducer 23. The impacting force is, thus, applied to the force pile 11. In addition, the strain gauge transducer creates a signal that is recorded on the associated track of the multiple track tape recorder 21. The impacting force causes a slight acceleration of the force pile 11. This acceleration is measured by the accelerometer 25 located on the force pile 11 and by the accelerometers 19 mounted on the remote piles 13. The accelerometers create electrical signals which are recorded, simultaneously with the strain gauge transducer produced signal, on the accelerometer associated tracks of the multiple track tape recorder. In this manner, force and acceleration data are simultaneously recorded on the various tracks of the multiple track tape recorder 21. Subsequent to one set of signals being simultaneously recorded, all of the piles are driven to a lower, equal depth. Thereafter, the cycle of operation is repeated and another set of signals is simultaneously recorded on the tracks of the multiple track tape recorder 21. After all of the desired data is obtained in this manner, the recorded data is analyzed in the manner hereinafter described to determine the soil transfer function.

Again, an alternative to the use of a mechanical system to create the desired force is an explosive system. In an explosive system the force is created by detonating a charge in the force pile 11.

Figure 3:
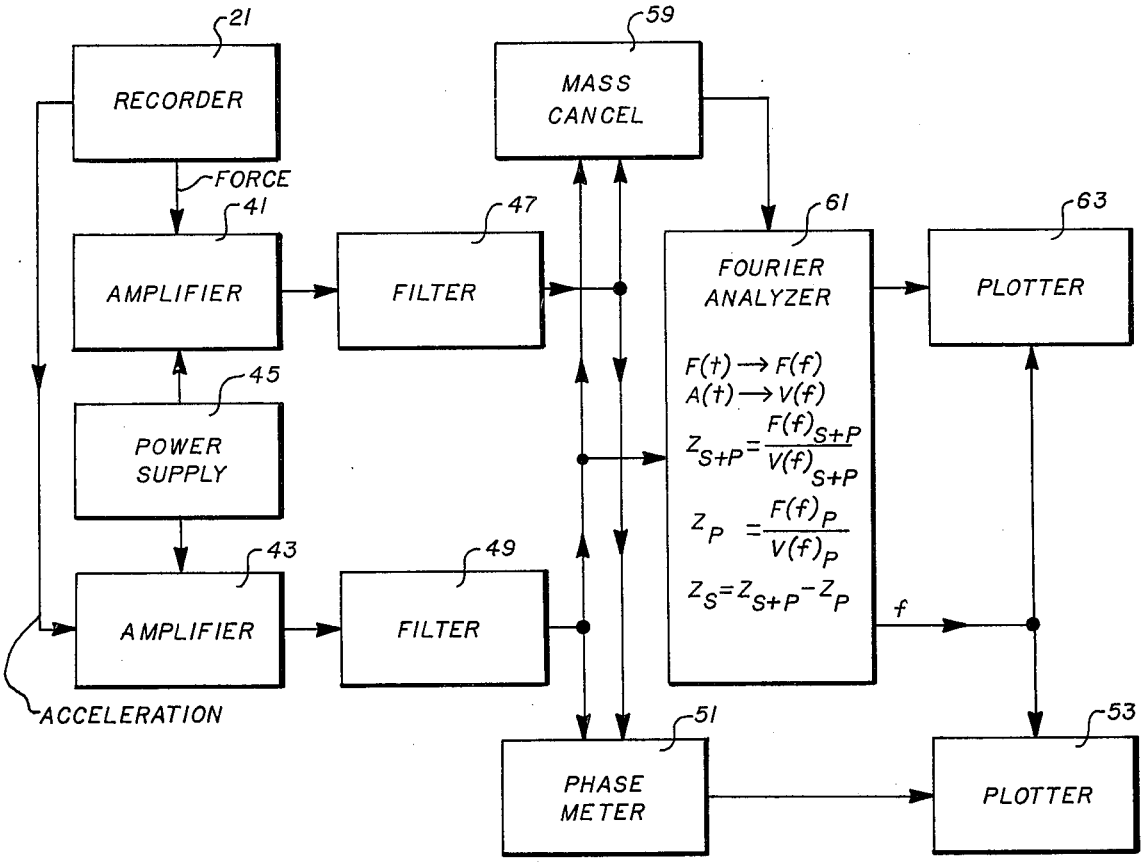
FIG. 3 is a block diagram of a system formed in accordance with the invention for analyzing the transfer function related signals obtained by the apparatus illustrated in FIGS. 1 and 2.

FIG. 3 illustrates a preferred apparatus for analyzing the recorded data and obtaining a graph of the soil transfer function. The apparatus illustrated in FIG. 3 comprises: the multiple track tape recorder 21; two amplifiers 41 and 43; a power supply 45; two filters 47 and 49; a phase meter 51; a first plotter 53; a mass cancel circuit 59; a Fourier analyzer 61; and a second plotter 63.

Two tracks of the tape recorder are always simultaneously played back. One of the tracks is an acceleration track and the other is its related force track. As will be better understood from the following description the Fourier analyzer transforms the playback signals and manipulates them. In addition, the Fourier analyzer stores the transformed manipulated signals, as necessary, while it transforms and manipulates other signals until it has all of the information necessary to create a signal that can be used to plot a graph representing the transfer function of the soil. For purposes of discussion, it is assumed that the force and acceleration signals related to the transfer functions of the piles (FIG. 1) were first recorded and that thereafter the transfer functions of the piles plus soil (FIG. 2) were recorded. However, it will be appreciated that this sequence could be reversed. In this regard, it should be noted that a plurality of acceleration signals, and a single force signal are recorded relating to the pile plus soil transfer function. Thus, the recorder sequentially cycles back and forth during playback so that the same force signal is applied to the apparatus illustrated in FIG. 3 along with different acceleration signals, determined by the position of a switch (not shown).

The power supply 45 is connected to supply power to the first and second amplifiers 41 and 43 in a conventional manner. The first amplifier 41 is connected to the multiple track tape recorder 21 to receive force signals and the second amplifier 43 is connected to receive acceleration signals. The output of the first amplifier 41 is connected through the first filter 47 to an input of the mass cancel circuit 59 and to an input of the phase meter 51. The output of the second amplifier 43 is connected through the second filter 49 to one input of the mass cancel circuit 59, an input of the Fourier analyzer and one input of the phase meter 51. Thus, both the mass cancel circuit 59 and the phase meter 51 receive force and acceleration signals. In essence, the multiple channel tape recorder 21, the amplifiers and filters form a coupling means between information sensing apparatus (FIGS. 1 and 2) and analyzing apparatus (FIG. 3).

The mass cancel circuit is designed to eliminate errors from the resultant transfer function display caused by undesirable masses, such as any mass located between the strain gauge transducer 23 and the force pile 11. More specifically, the strain gauge transducer 23 is usually separated from the force pile by some support structure. The mass created by this support structure will cause an error in the resultant display if its effect is not eliminated. The mass cancel circuit performs this function. Specifically, the mass cancel circuit includes a multiplier and a subtractor. The mass located between the strain gauge transducer and the force pile is determined by any conventional technique, such as by weighing it, for example. This mass information is inserted into the mass cancel circuit by adjusting a potentiometer, for example. The mass information is multiplied in the mass cancel circuit by the acceleration signal it receives from the second filter 49. The result of the multiplication is a signal related to force (force = mass × acceleration). This force signal is subtracted from the force signal applied to the mass cancel circuit by the first filter 47. Hence, the resultant force signal is a corrected force signal because errors in the original force signal created by the objectionable mass have been deleted. The corrected force signal is applied to the Fourier analyzer 61. Thus, the Fourier analyzer receives a corrected force and an acceleration signal each time the multiple track tape recorder is scanned i.e., a force and an acceleration track is played back.

The Fourier analyzer 61 performs a fast Fourier transform of its input signals and then manipulates those signals either in accordance with a program or in accordance with preset adjustments. While various Fourier analyzers can be used by the invention, a suitable one is identified by product number 5451A, produced by the Hewlett-Packard Corporation, 1101 Embarcadro Road, Palo Alto, California. In this regard, it should be noted that a suitably programmed general purpose digital computer can also be used by the invention to perform the functions of the Fourier analyzer 61.

The Fourier analyzer first converts the force and acceleration signals it receives from the time domain to the frequency domain. In addition, the acceleration signal is converted to a velocity signal (acceleration ÷ frequency). These signals are then divided (force by velocity) to create a transfer function (impedance) signal. As necessary, the Fourier analyzer stores the transform signals until it has transformed and manipulated all of the signals necessary to form a signal solely related to the transfer function of the soil. This final signal is obtained by subtracting pile transfer function signals from signals related to the transfer function of the soil plus piles.

Preferably, the sequence of operation is as follows: first, the tape recorder plays back the force and acceleration signals recorded when the piles were freely suspended. If an undesired mass was associated with the piles when these signals were recorded its effect is deleted by the mass cancel circuit in the manner previously described. The Fourier analyzer converts the ultimate force signal it receives from the time domain [F(t)] to the frequency domain [F(f)]. In addition, the Fourier analyzer converts the acceleration signal from the time domain [A(t)] to the frequency domain [A(f)]. The Fourier analyzer then converts the transformed acceleration signal into a velocity signal (acceleration ÷ frequency). The resultant signals are divided into one another (force by velocity) to obtain a transfer function signal [$Z_p$] related solely to the pile associated with the played back force and acceleration signals. The foregoing sequence of steps is performed for each pile and the resultant signals are stored in the Fourier analyzer.

As discussed above, force and acceleration signals are simultaneously recorded after the piles have been driven into the soil, as one pile (the force pile) is impacted. The piles are associated such that each remote pile forms a pair with the force pile. These signals are defined as soil plus pile signals and are transformed and manipulated by the Fourier analyzer (after mass cancellation) in the same manner as the force and acceleration signals related solely to the piles to form transfer point transfer function [$Z_{S+P}$] signals. In addition, the force and acceleration signals related to the force pile when it is in the soil are transformed and manipulated to form a driving point transfer function signal. These signals are also stored in the Fourier analyzer. Thereafter, the pile transfer function signals related to a pair of piles are subtracted from the transfer point transfer function signal related to the same pair (or group of pairs), and the force pile transfer function signal is subtracted from the driving point transfer function signals. The result of the subtractions are a series of signals solely related to the transfer functions of the soil. These signals are applied to the second plotter 63 to create a series of graphs of the type illustrated in FIG. 5.

The foregoing description has described the sequence of operation such that all pile transfer function signals are first obtained and stored, and then the transfer point transfer function and driving point transfer function signals are obtained and stored. Finally, the necessary subtraction steps for each set of related signals is performed. Obviously, this sequence can be varied. For example, only the pile transfer function signals related to a particular transfer point transfer function signal need be obtained and stored before that transfer point transfer function signal is obtained. Moreover, this sequence can be reversed i.e. the transfer point transfer function signal obtained and stored before the pile transfer function signals are obtained.

Figure 5:
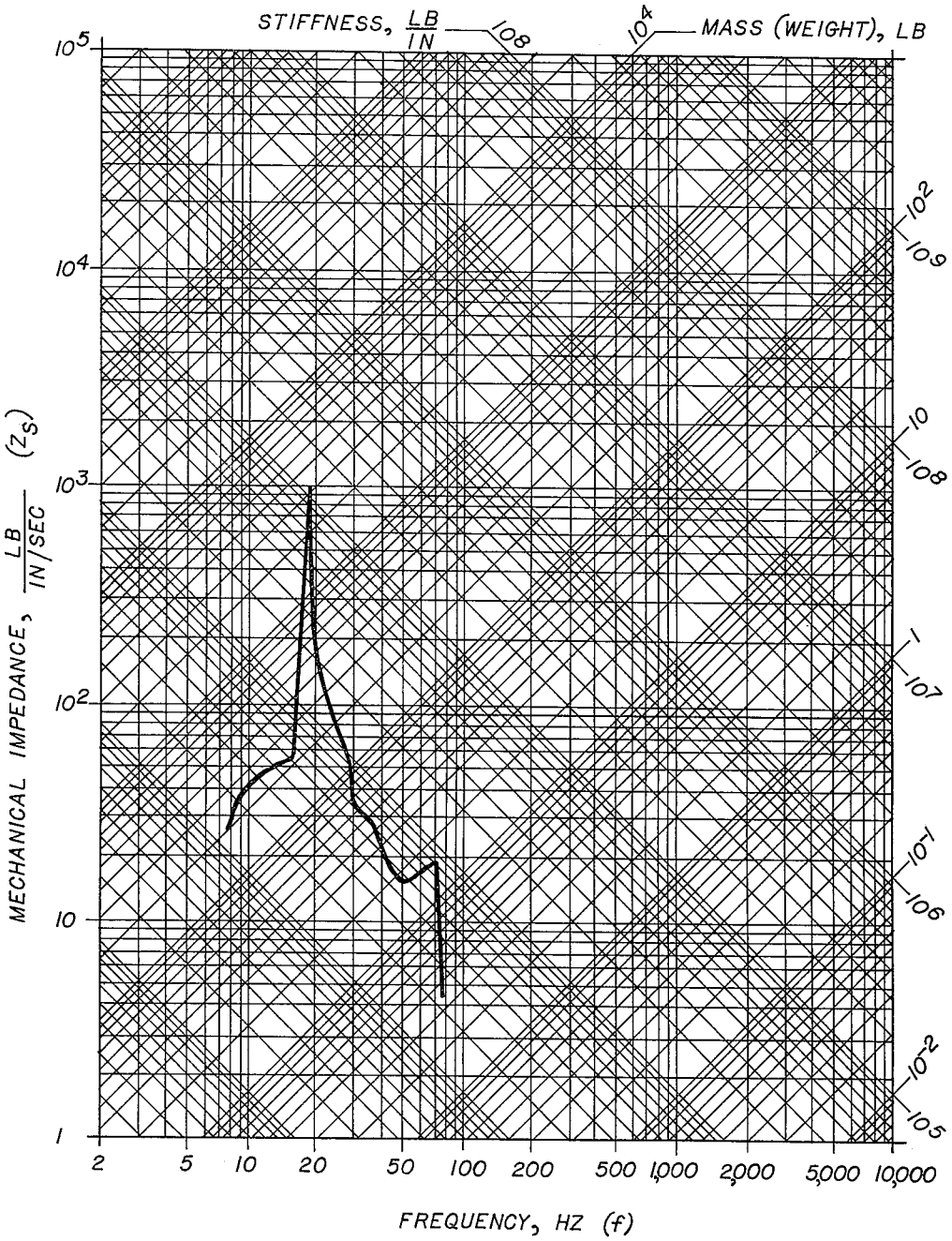

As indicated above, the resultant soil transfer function signals create a series of graphs. From these graphs soil dynamic stiffness, soil dynamic mass, soil damping and soil resonances can be determined. The graphs are formed on a special type of graph paper well known to those skilled in the art. FIG. 5 illustrates such graph paper and a representative soil transfer function graph. The graph paper includes two sets of orthogonal log-log axes, one set rotated 45° with respect to the other set. The soil transfer function ($Z_S$) is plotted against frequency (also obtained as a signal from the Fourier analyzer) on one set of axes. The second set of axes provide information related to soil dynamic stiffness and soil dynamic mass. Thus, dynamic stiffness and dynamic mass can be read directly from the resultant graph. Soil damping, which is the width of the half power point at resonance, is determined by a standard operation. And resonance is read directly on the frequency axis. Thus, all of the desired information is readily and rapidly available.

Figure 4:
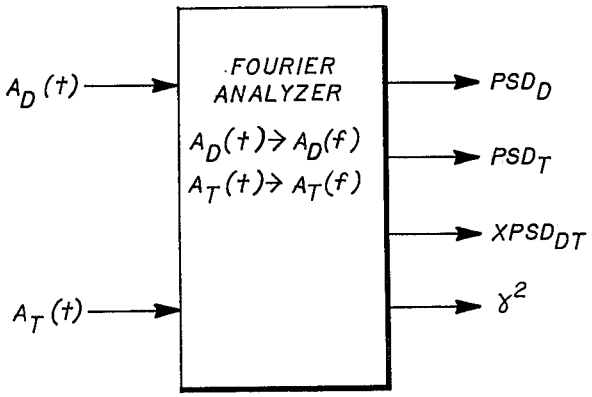
FIG. 4 is a block diagram illustrating a Fourier analyzer utilized to determine the validity of the acceleration information derived when the piles are located in the ground; and, FIG. 5 is a graph depicting the transfer function of soil created by an apparatus formed in accordance with the invention.

It will be appreciated that errors will be contained in the resultant information if forces are applied to the soil under test from some external, uncontrolled source during the impacting and recording operations. Thus, it is desirable to determine whether or not the recorded signals are or are not valid. In accordance with the invention, the Fourier analyzer is also programmed or adjusted to provide this information. The procedure for determining the validity of the recorded signals is preferably performed before the transfer function graphs are obtained; however, it could be performed thereafter. The procedure for determining recorded signal validity is illustrated in FIG. 4. First, all of the acceleration signals recorded during impacting are converted from the time domain to the frequency domain. Then, the power spectrum of each of these is obtained. This is done for the acceleration signal ($A_D$) taken from the force pile to obtain a force pile power spectrum signal, $PSD_D$, and for the acceleration signals ($A_T$) taken from each remote pile to obtain a series of remote pile power spectrum signals, $PSD_T$. The crosspower spectrum between the force pile spectrum and each remote pile spectrum is then computed and squared. Then, the coherence function between all signals are formed by dividing respective cross power spectra squared by the product of the respective power spectra. Signals which do not create satisfactory coherence are rejected as unusable. The usable force and acceleration signals are processed in the manner previously described to create the resultant soil transfer function graphs.

In order to be able to fully define the dynamic parameters of the soil, the phase relationship between each related set of force and acceleration signals must be determined. The phase meter 51, in a conventional manner, determines these relationships as the signals are applied to the Fourier analyzer 61. The resultant phase difference signal is applied to the first plotter 53 which plots phase differences vs. frequency, the frequency signal being obtained from the Fourier analyzer.

As indicated above, the foregoing process is repeated for different pile depths. In this manner, a complete set of graphs depicting the transfer functions of the soil are derived. Since the boundary conditions of the soil remained unchanged during signal recording and analysis, i.e., the soil was not moved to a remote location for analysis purposes as required by the prior art, the resultant graphs take into consideration natural soil boundary conditions. Hence, they are highly accurate, particularly when compared with graphs obtained using prior art techniques requiring soil removal for analysis purposes.

While a preferred embodiment of the invention has been illustrated and described, it will be appreciated by those skilled in the art and others that various changes can be made therein without departing from the spirit and scope of the invention. For example, while the impact force is preferably measured at the driving pile, it could be measured at a remote pile, assuming suitable precautions are taken so that an accurate force measurement is obtained. Further, the various steps performed by the apparatus during the analysis of the resultant force and acceleration signals can be varied in sequence, as desired. Moreover, the multiple track tape recorder can be eliminated and site analysis performed, if desired. Hence, the invention can be practiced otherwise than as specifically described herein.

The embodiments of the invention in which exclusive property or privilege is claimed are defined as follows:

We claim:

1. A method of determining the dynamic parameters of soil in situ comprising the steps of:

1. determining the transfer function of at least two piles, one of said piles defined as a force pile and the other of said piles defined as a remote pile;
2. embedding said force and remote piles into the soil whose dynamic parameters are to be determined;
3. determining the transfer function of the piles plus the soil by:
   a. determining the driving point transfer function at the force pile; and,
   b. determining the transfer point transfer function at the remote pile; and,
4. selectively subtracting the transfer function of the piles from the driving point transfer function and from the transfer point transfer function to determine the transfer function of the soil.

2. A method of determining the dynamic parameters of soil in situ as claimed in claim 1 wherein the step of determining the transfer function of at least two piles comprises the substeps of:

separately suspending the piles;
impacting each suspended pile;
measuring the impact force applied to each suspended pile;
simultaneously measuring the acceleration of each suspended pile created by the impacting force;
converting the simultaneously measured acceleration into velocity; and,
dividing the measured force by the velocity converted from the simultaneously measured acceleration.

3. A method of determining the dynamic parameters of soil in situ as claimed in claim 2 wherein the force and acceleration, measured when the piles are separately suspended, are converted from the time domain to the frequency domain prior to the simultaneously measured acceleration being converted into velocity and divided into the measured force.

4. A method of determining the dynamic parameters of soil in situ as claimed in claim 3 wherein the piles are driven to equal depths in the soil whose dynamic parameters are to be determined.

5. A method of determining the dynamic parameters of soil in situ as claimed in claim 3 wherein the step of determining the transfer function of the piles plus the soil comprises the substeps of:

impacting the force pile;
measuring the impact force applied to the force pile;
measuring the acceleration of the force pile caused by the impact force;
converting the acceleration of the force pile caused by the impact force into velocity; and,
dividing the measured force by the velocity converted from the measured acceleration to determine the driving point transfer function at the force pile.

6. A method of determining the dynamic parameters of soil in situ as claimed in claim 5 wherein the force and acceleration, measured when the piles are located in the soil, are converted from the time domain to the frequency domain prior to the acceleration being converted into velocity and divided into the measured force.

7. A method of determining the dynamic parameters of soil in situ as claimed in claim 5 wherein the step of determining the transfer function of the piles plus the soil also comprises the substeps of:

measuring the acceleration at the remote pile due to the acceleration of the force pile caused by the impact force;

converting the acceleration measured at the remote pile into velocity; and, dividing the force measured at the force pile by the velocity to determine the transfer point transfer function at the remote pile.

8. A method of determining the dynamic parameters of soil in situ as claimed in claim 7 wherein the force and acceleration, measured when the piles are located in the soil, are converted from the time domain to the frequency domain prior to the acceleration being converted into velocity and divided into the measured force.

9. A method of determining the dynamic parameters of soil in situ as claimed in claim 8 including the step of subtracting erroneous information created by undesirable, predetermined masses, affixed to said remote and force piles, from the measured force.

10. A method of determining the dynamic parameters of soil in situ as claimed in claim 1 wherein the step of determining the transfer function of the pile plus the soil comprises the substeps of:

impacting the force pile;

measuring the impact force applied to the force pile;

measuring the acceleration of the force pile caused by the impact force;

converting the acceleration of the force pile into velocity; and, dividing the measured force by the velocity to determine the driving point transfer function at the force pile.

11. A method of determining the dynamic parameters of soil in situ as claimed in claim 10 wherein the force and acceleration, measured when the piles are located in the soil, are converted from the time domain to the frequency domain prior to the acceleration being converted into velocity and divided into the measured force.

12. A method of determining the dynamic parameters of soil in situ as claimed in claim 10 wherein the step of determining the transfer function of the piles plus the soil also comprises the substeps of:

measuring the acceleration at the remote pile due to the acceleration of the force pile caused by the impact force;

converting the acceleration measured at the remote pile into velocity; and, dividing the force measured at the force pile by the velocity to determine the transfer point transfer function at the remote pile.

13. A method of determining the dynamic parameters of soil in situ as claimed in claim 12 wherein the force and acceleration, measured when the piles are located in the soil, are converted from the time domain to the frequency domain prior to the acceleration being converted into velocity and divided into the measured force.

14. A method of determining the dynamic parameters of soil in situ as claimed in claim 13 including the step of subtracting erroneous information created by undesirable, predetermined masses, affixed to the force and remote piles, from the measured force.

15. A method of determining the dynamic parameters of soil in situ as claimed in claim 1 including the step of determining the coherence between power spectra of related measured force and acceleration to detect erroneous information created by uncontrolled forces present in said soil when the force pile is impacted by said impact force.

16. Apparatus for determining the dynamic parameters of soil in situ as claimed in claim 15 including a plurality of remote piles and wherein said pile plus soil transfer function sensing means comprises:

impacting means for impacting said force pile;

force measuring means for measuring the impact force applied to said force pile and for generating a pile plus soil force signal related thereto;

acceleration means located at said force pile for measuring the acceleration of said force pile caused by said impacting means and for generating a driving point pile plus soil acceleration signal related thereto; and, acceleration means located at said remote piles for measuring the acceleration of said remote pile caused by said impacting means impacting said force pile and for generating transfer point pile plus soil acceleration signals related thereto, one for each remote pile.

17. Apparatus for determining the dynamic parameters of soil in situ comprising:

pile transfer function sensing means for sensing the transfer function of a plurality of piles including a force pile and at least one remote pile, and for generating signals related thereto;

pile plus soil transfer function sensing means for sensing force and acceleration information combinable to determine the driving point transfer function at the force pile and the transfer point transfer function at the at least one remote pile when said force pile and said at least one remote pile are located in the soil whose dynamic parameters are to be determined, and for generating signals related thereto;

analyzing means for determining the transfer function of said soil by manipulating said signals generated by said pile transfer function sensing means and said pile plus soil transfer function sensing means in a manner such that the signals generated by said pile transfer function sensing means are subtracted from the signals generated by the pile plus soil transfer function sensing means in a predetermined manner; and, coupling means selectively connected to said pile transfer function sensing means and said pile plus soil transfer function sensing means for conveying the signals generated by said pile transfer function sensing means and said pile plus soil transfer function sensing means to said analyzing means.

18. Apparatus for determining the dynamic parameters of soil as claimed in claim 17 wherein said pile transfer function sensing means comprises:

suspending means for separately suspending said piles;

impacting means for impacting said piles when suspended;

force sensing means for sensing the impact force applied to said suspended piles and for generating pile force signals related thereto; and, acceleration sensing means for sensing the acceleration of said suspended piles caused by said impacting means and for generating pile acceleration signals related thereto.

19. Apparatus for determining the dynamic parameters of soil in situ as claimed in claim 18 wherein said pile plus soil transfer function sensing means comprises:

impacting means for impacting said force pile;

force measuring means for measuring the impact force applied to said force pile and for generating a pile plus soil force signal related thereto; and, first acceleration means located at said force pile for measuring the acceleration of said force pile caused by said impacting means and for generating a driving point pile plus soil acceleration signal related thereto; and, second acceleration means located at said at least one remote pile for measuring the acceleration of said remote pile caused by said impacting means impacting said force pile and for generating a transfer point pile plus soil acceleration signal related thereto.

20. Apparatus for determining the dynamic parameters of soil in situ as claimed in claim 19 wherein said analyzing means includes a Fourier analyzer adapted to: (1) receive said pile force and acceleration signals, said driving point pile plus soil force and acceleration signals and said transfer point pile plus soil acceleration signals; (2) transform said signals from the time domain to the frequency domain; (3) convert said transformed pile acceleration signals and said transformed driving point and transfer point pile plus soil acceleration signals into transformed pile velocity signals and transformed pile plus soil velocity signals, respectively; (4) selectively divide said transformed pile force signals by said transformed pile velocity signals and said transformed pile plus soil force signals by said transformed pile plus soil velocity signals to obtain pile transfer function signals and pile plus soil transfer function signals, respectively; and, (5) subtract associated pile transfer function signals from pile plus soil transfer function signals to obtain at least one soil transfer function signal.

21. Apparatus for determining the dynamic parameters of soil in situ as claimed in claim 20 wherein said Fourier analyzer is also adapted to determine the coherence between said force and acceleration signals in order to detect which of said signals contain information created by forces unconnected with the force created by said impacting means.

22. Apparatus for determining the dynamic parameters of soil in situ as claimed in claim 21 wherein said coupling means includes a multiple channel tape recorder.

23. Apparatus for determining the dynamic parameters of soil in situ as claimed in claim 22 including a plotting means connected to said Fourier analyzer for plotting said at least one soil transfer function signal with respect to frequency.

24. Apparatus for determining the dynamic parameters of soil as claimed in claim 23 including a phase measuring means connected to said coupling means to receive related force and acceleration signals and determine the phase difference between said signals.

25. Apparatus for determining the dynamic parameters of soil in situ as claimed in claim 24 including a second plotting means connected to said Fourier analyzer and to said phase measuring means for plotting the phase difference between related force and acceleration signals with respect to frequency.

26. Apparatus for determining the dynamic parameters of soil in situ as claimed in claim 25 including mass cancel means connected to said coupling means to receive related force and information signals and subtract from the received force signal information related to undesired, predetermined masses affixed to a related pile to create corrected force signals and apply them to said Fourier analyzer.

27. Apparatus for generating signals related to the transfer function of piles plus soil, said piles being embedded into said soil and including a force pile and at least one remote pile, said apparatus comprising:

impacting means for impacting said force pile;

force measuring means for measuring the impact force applied to said force pile and for generating a pile plus soil force signal related thereto;

first acceleration means for measuring the acceleration of said force pile caused by said impacting means and for generating a driving point pile plus soil acceleration signal related thereto; and, second acceleration means for measuring, at said at least remote pile, the acceleration of said remote pile caused by said impacting means impacting said force pile and for generating transfer point pile plus soil acceleration signals related thereto, one for each remote pile.

28. Apparatus for analyzing: force and acceleration signals related to the transfer functions of piles; and, a pile plus soil force signal, a driving point pile plus soil acceleration signal and at least one transfer point pile plus soil acceleration signal to determine the dynamic parameters of soil in situ, said apparatus comprising:

a Fourier analyzer adapted to: (1) receive said pile force and acceleration signals, said driving point pile plus soil force and acceleration signals and said at least one transfer point pile plus soil acceleration signals; (2) transform said signals from the time domain to the frequency domain; (3) convert said transformed pile acceleration signals and said transformed driving point and transfer point pile plus soil acceleration signals into transformed pile velocity signals and transformed pile plus soil velocity signals, respectively; (4) selectively divide said transformed pile force signals by said transformed pile velocity signals and said transformed pile plus soil force signals by said transformed pile plus soil velocity signals to obtain pile transfer function signals and pile plus soil transfer function signals, respectively; and, (5) subtract associated pile transfer function signals from pile plus soil transfer function signals to obtain at least one soil transfer function signal; and, a plotting means connected to said Fourier analyzer for plotting said at least one soil transfer function signal with respect to frequency.

29. Apparatus for analyzing force and acceleration signals to determine the dynamic parameters of soil in situ as claimed in claim 28, wherein said Fourier analyzer is also adapted to determine the coherence between various of said force and acceleration signals in order to detect signals containing information created by forces unconnected with the forces creating said force and acceleration signals.

30. Apparatus as claimed in claim 28 including a phase measuring means for receiving related force and acceleration signals and determining the phase difference between said signals.

31. Apparatus as claimed in claim 30 including a second plotting means connected to said Fourier analyzer and to said phase analyzing means for plotting the phase difference between related force and acceleration signals with respect to frequency.

32. Apparatus as claimed in claim 31 including mass cancel means for receiving related force and acceleration signals and subtracting from the received force signal information related to undesired, predetermined masses affixed to the piles associated with said force and acceleration signals to create corrected force signals and applying said corrected force signals to said Fourier analyzer.

* * * * *